United States Patent [19]

Bach et al.

[11] 4,174,509

[45] Nov. 13, 1979

[54] FURNACE TRANSFORMER HAVING A LOW-VOLTAGE INTERNALLY-CONNECTED DELTA WINDING

[75] Inventors: Werner Bach, Pittsfield; George Kardasen, Jr., Dalton, both of Mass.

[73] Assignee: General Electric Company

[21] Appl. No.: 865,700

[22] Filed: Dec. 29, 1977

[51] Int. Cl.[2] ..... H01F 33/00

[52] U.S. Cl. ..... 336/12; 336/184

[58] Field of Search ..... 336/5, 10, 12, 180, 336/182, 184; 323/48, 49

[56] References Cited

U.S. PATENT DOCUMENTS

| | | | |
|---|---|---|---|
| 2,424,973 | 8/1947 | Edmonds | 336/5 |
| 3,235,823 | 2/1966 | Renberg, Jr. | 336/12 |
| 3,436,703 | 4/1969 | Schlawin | 336/12 |
| 3,465,272 | 9/1969 | Bach | 336/12 |
| 3,760,314 | 9/1973 | Krasienko et al. | 336/12 X |

*Primary Examiner*—Thomas J. Kozma

*Attorney, Agent, or Firm*—Francis X. Doyle; Richard A. Menelly

[57] ABSTRACT

A high current furnace transformer is provided having the low-voltage windings arranged in a closed delta configuration within the transformer enclosure. Bus bar terminals are mounted exterior to the enclosure for providing electrical connection with the low-voltage windings.

8 Claims, 7 Drawing Figures

FURNACE TRANSFORMER HAVING A LOW-VOLTAGE INTERNALLY-CONNECTED DELTA WINDING

BACKGROUND OF THE INVENTION

Three-phase furnace transformers are used in applications requiring currents in orders of magnitudes approximating 100 K amperes. The furnace transformers are used for supplying arc furnaces with substantially high currents with voltages in the order of a few hundred volts.

The conventional method of wiring the three-phase low-voltage windings for furnace transformers is in a closed delta configuration. Because of the high currents involved, thick electrical conductors, such as bar conductors, are used for carrying the high currents from within the transformer to the transformer outer terminals. The present method of manufacturing furnace transformers consists in bringing the bus bar connectors from the different low-voltage winding legs out to the top of the transformer with the delta unclosed. Every furnace transformer, therefore, must be custom wired by the user. The custom wiring includes closing the delta by means of a plurality of bus bar connections with the bus bar contacts external to the transformer casing. Due to the large current passing through the bus bar contacts the externally exposed contacts and connectors may have to be supplied with supplemental cooling to prevent overheating during periods of high current usage.

The purpose of this invention is to provide means and methods for manufacturing a furnace transformer having low-voltage windings in a closed delta configuration with minimum losses. The internally closed delta furnace transformer of the invention also provides means for integrally cooling the bus bar.

SUMMARY OF THE INVENTION

Three-phase furnace transformers having low-voltage windings in an internally-closed delta connection are provided with bus bar connections internal to the transformer housing. The internally closed delta bus bar connections are completely enveloped by the transformer dielectric medium and become integrally cooled along with the transformer core and windings.

The internally closed delta furnace transformer of the invention provides bus bar contacts which require no further electrical interconnection and are substantially reduced in size and quantity.

GENERAL DESCRIPTION OF THE PRIOR ART

Figure 1:
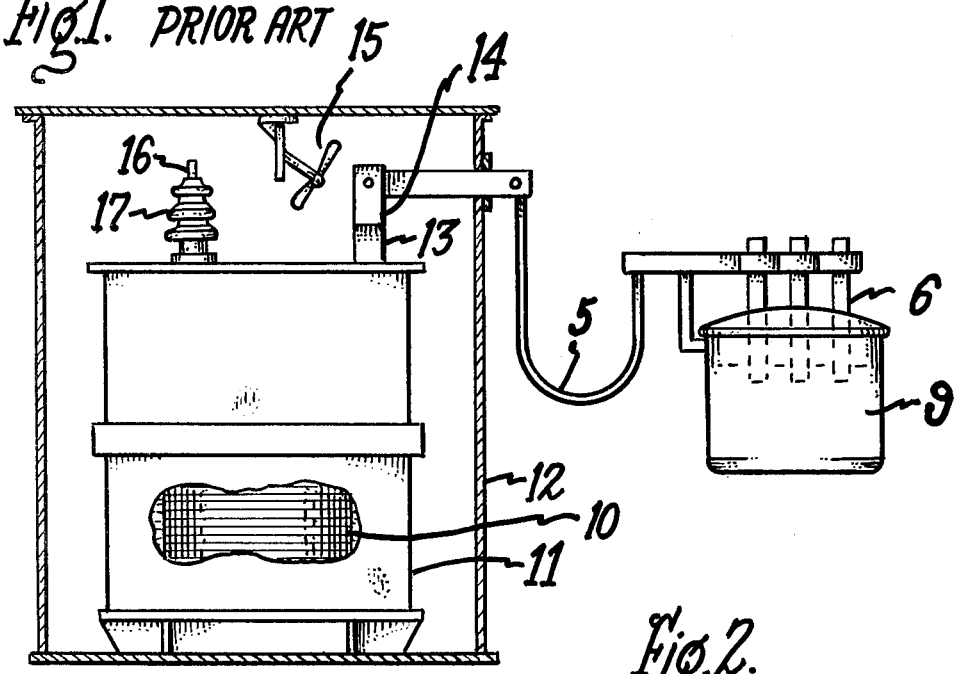
Fig. 1. PRIOR ART
FIG. 1 is a side view representation of an arc furnace and a prior art furnace transformer.

FIG. 1 shows a furnace transformer 10 of the type used to supply an arc furnace 9 with electrical power. The current is supplied from transformer 10 to the arc furnace 9 by means of large diameter flexible leads 5. The reason for the large current requirement is to provide the electrodes 6 with sufficient electrical power to melt large quantities of metal such as in a metal smelting operation. The furnace transformer 10, of the type having a metal casing 11 with a plurality of bus bars 13 extending out from the top surface of casing 11, is generally kept in a specially designed room 12 commonly referred to as a "vault." The transformer 10 is of the type having a plurality of low-voltage windings in an unclosed delta configuration and the low voltage delta must be closed subsequent to shipping the transformer 10 to the place of intended use. Once the transformer 10 is located relative to the arc furnace 9, the low-voltage delta must be closed by means of a plurality of bus bar connectors 14 electrically and mechanically connected with bus bars 13 at the place of intended use. Because of the substantial currents through the bus bar 13, and bus bars connectors 14, forced air cooling is usually provided by means of fan 15. The use of a transformer 10 having extending bus bars 13 in which the transformer low-voltage windings are in an open delta configuration requires a substantial amount of material and labor after shipment along with a large expenditure of time before the transformer 10 is in operating condition. One example of an internal bus connection for high-current delta-connected transformers can be seen by referring to U.S. Pat. No. 3,465,272 which patent is incorporated herein by way of reference. The aforementioned patent utilizes loop-shaped connectors equal in number to the number of phases for closing the delta connection within the transformer housing. The use of the loop-shaped connectors conveniently provides bus terminal connectors extending through the side of the transformer casing. The use of loop-shaped connectors, however, does not readily apply to applications where the external bus terminal connectors must extend through the top section of the transformer casing.

DESCRIPTION OF THE PREFERRED EMBODIMENTS

Figure 2:
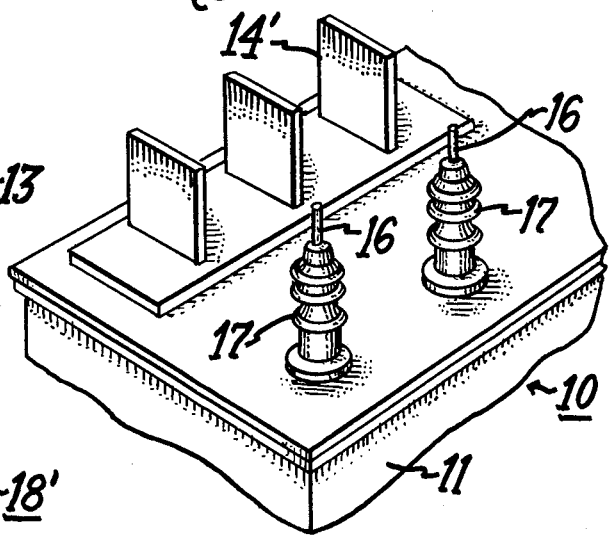
FIG. 2 is a top perspective view of a transformer having internally-closed delta connections according to the invention.
Figure 3:
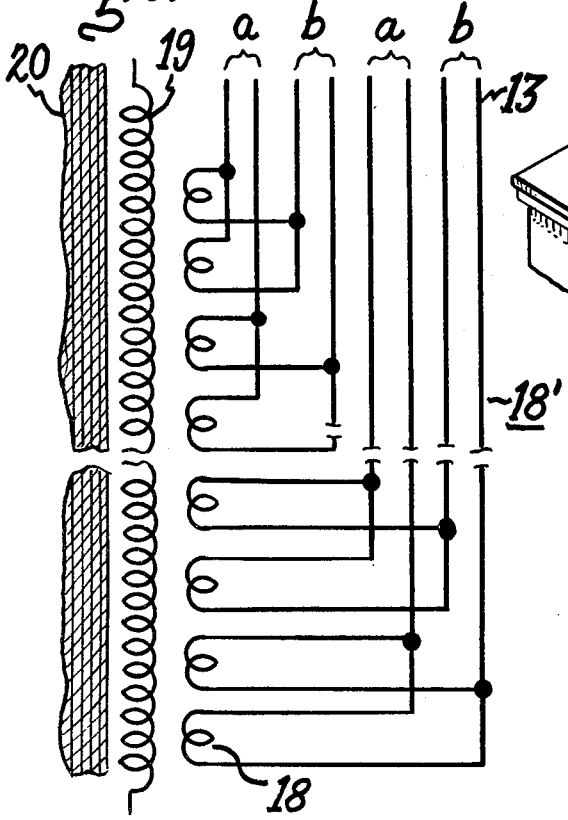
FIG. 3 is a schematic representation of the low-voltage windings and bus bars for use within the furnace transformer according to the invention.

A furnace transformer having a low-voltage internally-connected delta winding can be seen by referring to FIG. 2. Transformer 10 of the type having a metallic casing 11 and bushings 17 also includes three bus bar terminals 14' mounted on the top surface of the casing 11. As is common with high-current type furnace transformers, the low-voltage winding 18 generally consist of a large number of parallel circuits 18' connected by means of thick metallic bus bars 13 in order to carry the large currents involved without overheating. FIG. 3 shows a low-voltage winding 18 relative to a high-voltage winding 19 and core 20. The low-voltage winding 18 consists of a plurality of coils **18*a*, 18*b*, 18*c* each of the coils being electrically connected to a corresponding plurality of bus bars 13. In the prior art device of FIG. 1, the bus bars 13 are brought through the top surface of the casing 11 and the external electrical terminals 14'** are used to close the low-voltage delta.

Figure 4:
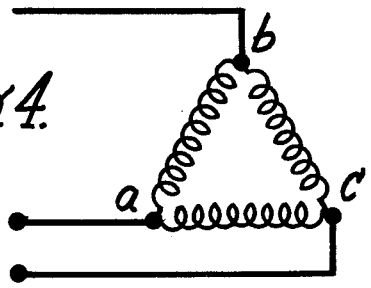
FIG. 4 is a schematic representation of a delta-connected configuration.

FIG. 4 shows a common delta connection for a closed delta configuration. The electrical terminals for the delta configuration are a, b, and c. It is to be noted that the low-voltage winding 18 of FIG. 3 is for one phase of a three-phase transformer, and that terminals a and b connect with the coils 18 on one leg of the three-leg transformer core commonly used in three-phase transformer systems as indicated. A corresponding plurality of low-voltage coils 18 similarly exist for the other two phases each connecting correspondingly with terminals b and c, and c and a to complete the delta diagram of FIG. 4.

Figure 5:
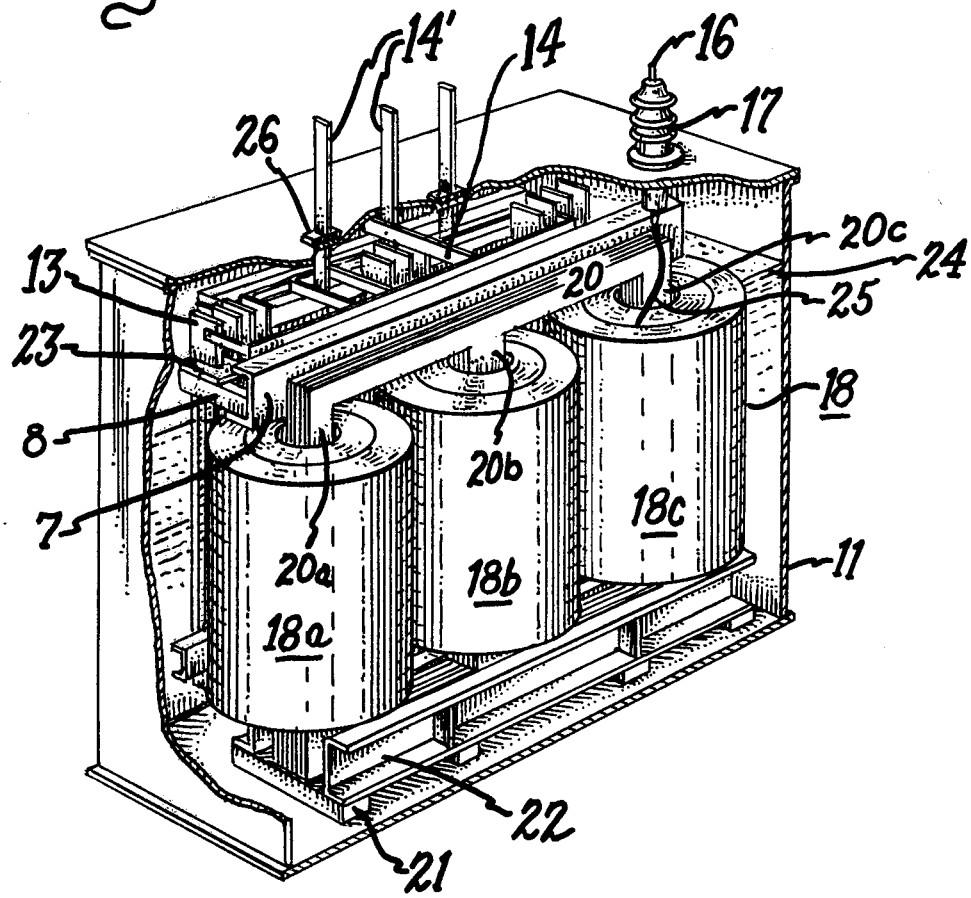
FIG. 5 is a side perspective view in partial section of a furnace transformer having a low-voltage internally-closed delta winding according to the invention.

In the embodiment of FIG. 5 the low-voltage delta windings are made in the following manner: Transformer 10 consists of an electromagnetic core 20 having a first leg 20*a*, second leg 20*b*, and third leg 20*c*. The first low-voltage winding 18*a* is wrapped around the first leg 20*a*, the second low-voltage winding 18*b* is wrapped around the core leg 20*b* and the third low-voltage winding 18*c* is wrapped correspondingly around the third core leg 20*c* to constitute the entire three-phase low-voltage windings 18. The entire low-voltage winding 18 and the core 20 are supported upon a base 21 by means of support members 22 and are totally immersed within a dielectric liquid 24 which usually consists of a transformer oil. Also, within casing 11 there is provided a plurality of bus bar connectors 14 for electrically interconnecting the bus bars 13 that correspond to the open connections for each of the corresponding low-voltage windings 18*a*, 18*b*, and 18*c*. An electrically-insulated shelf 23 is generally provided within casing 11 and supported by means of shelf supports 8 fixedly attached to the core frame 7 to provide support to the bus bar structure. The bus bar connectors 14 consisting of the same thick metal bars used for forming the bus bars 13 connect through casing 11 by means of extended bus bar terminals 14' through seals 26. The terminal contacts 16 for the transformer 10 connect through the casing 11 by means of bushings 17 and provide electrical connection to the low-voltage windings 18 by means of lead 25.

Figure 6:
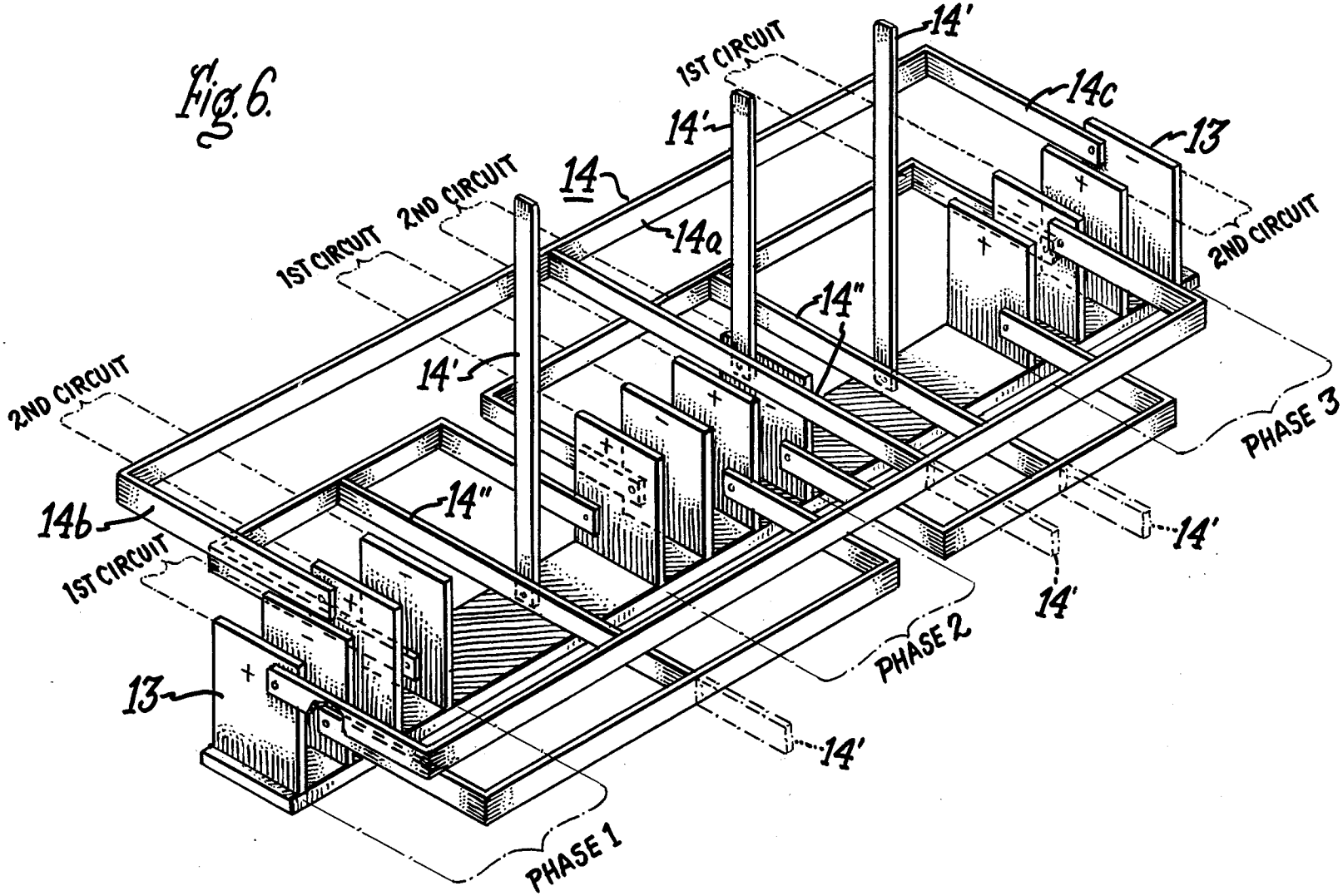
FIG. 6 is an exploded perspective view of the delta connection of FIG. 5.

When the transformer 10 of FIG. 5 is delivered to the intended user, the electrical connections between transformer 10 and an arc furnace can be readily made with the bus bar terminals 14' without providing external bus bar connections to close the low-voltage delta circuits as with prior devices. Since the bus bar connectors 14 are located within the transformer casing 11 they are completely immersed within the transformer dielectric fluid 24 and become cooled by the same mechanism that provides cooling to the core 20. No external fans or supplementary heat-exchange devices should be required for the bus bar connectors 14. FIG. 6 is an exploded view of the bus connectors 14 of FIG. 5. Each parallel circuit in the secondary winding ends in a bus bar array corresponding to the positive and negative ends of each pair of parallel circuits in each phase of the transformer winding as indicated.

In order to efficiently interconnect between each of the three phases (1, 2, 3) the connectors 14 are arranged as follows. The bus bar array is divided into a plurality of pairs of first and second parallel circuits, each pair ending in a positive and a negative end. The bus bar connectors 14 are connected between the ends of the first pair of circuits on one side of the bus bar 13 and the ends of the second pair of circuits are connected on the opposite side of the bus bar 13 as shown. The alternate connections provide a compact configuration which can handle as many circuit pairs as may be required by a vertical stacking arrangement. The bus bar terminals 14' can be positioned vertically upward as indicated or can be positioned in a horizontal arrangement 14' shown in dotted lines when connection is to be made, for example, on the side of the transformer near the top. For the purpose of the embodiment of FIG. 6 the bus connectors 14 comprise U-shaped bars of copper having a bight section 14*a* and parallel end sections 14*b*, 14*c*. The cross connectors 14'' and the bus terminals 14' comprise straight metallic bars.

Figure 7:
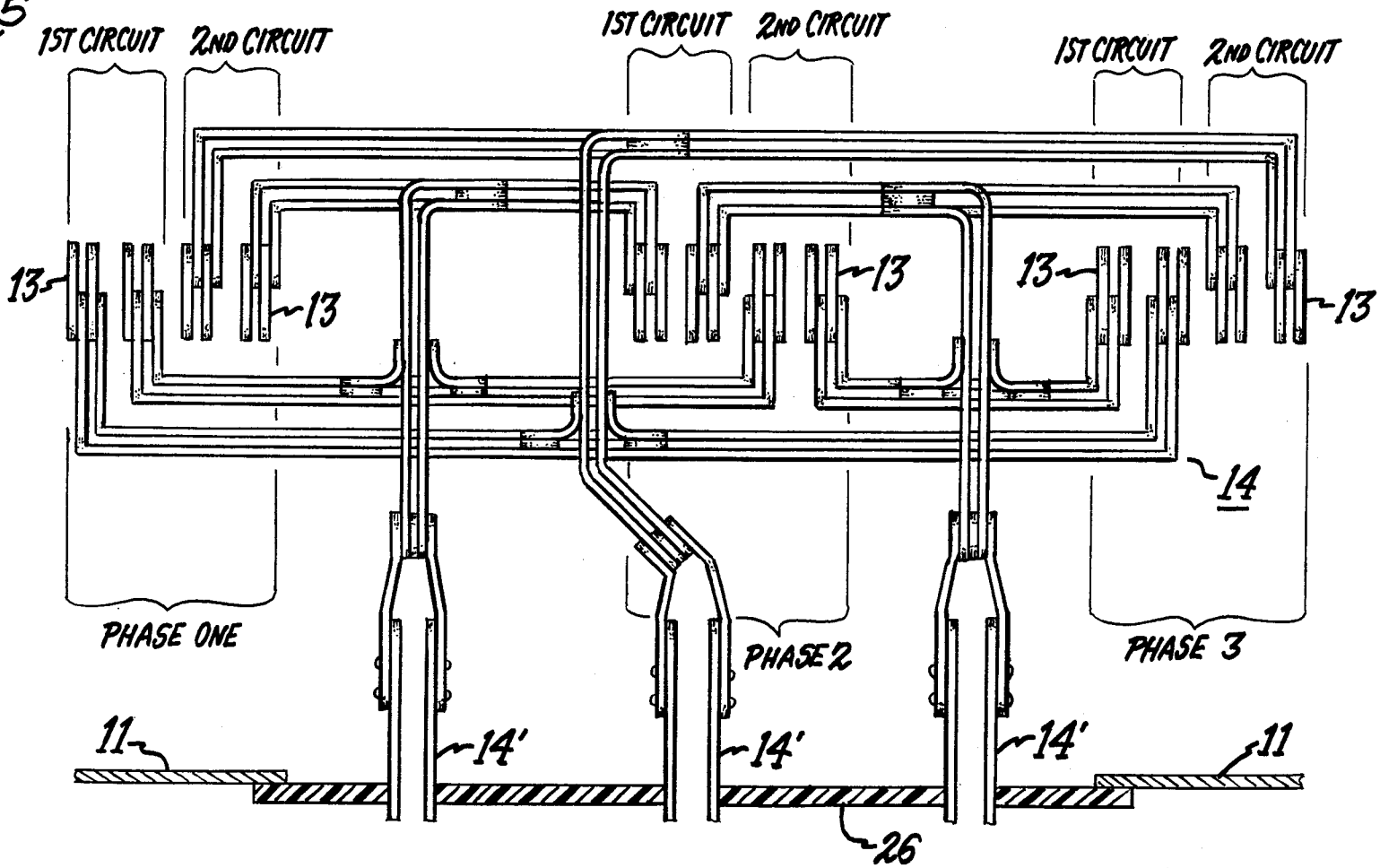
FIG. 7 is a plan view of a further delta configuration according to the invention.

FIG. 7 is a top view of a delta closure for high current application wherein eight bus bars 13 are employed compared to the four bus bar embodiment of FIG. 6. Here the eight bus bars 13 are closed by a plurality of bus bar connectors 14 in a similar delta configuration as disclosed earlier. The seal 26 encompasses six bus bar terminals 14' extending through the side of transformer casing 11.

The internally-closed low-voltage delta connection of the invention is described relative to high current type furnace transformers. This is by way of example only since the internally closed low-voltage delta connection of the invention readily finds application wherever high-current transformers are to be employed and bus bar contacts are used for connection with the low-voltage windings.

We claim:

1. A high-current transformer having an internal delta closure comprising:

a plurality of low-voltage windings concentrically arranged within a transformer casing around corresponding high-voltage windings on each leg of a three-leg electromagnetic core, each leg providing one phase of a three-phase arrangement, each phase consisting of at least one pair of first and second parallel circuits, each of said parallel circuits having a positive and a negative end;

a vertical bus bar array connecting with each of said positive and negative ends;

a first plurality of bus bar connectors within the transformer casing connecting the positive and negative circuit ends in a delta connection by coupling the ends of the first circuit in the first phase to the ends of the second circuit in the second phase and the ends of the first circuit in the third phase on one side of the bus bar array; and a second plurality of bus bar connectors coupling the ends of the second parallel circuit in the first phase to the ends of the first parallel circuit in the second phase and the ends of the second parallel circuit in the third phase on another side of the bus bar array.

2. The transformer of claim 1 including a plurality of further bus bar connectors for electrically coupling between said first and second phases, said second and third phases, and said first and third phases.

3. The transformer of claim 2 wherein the first and second plurality of bus bar connectors comprise U-shaped bus bars extending horizontal to said vertical bus bar array.

4. The transformer of claim 3 wherein the further bus bar connectors comprise linear bus bar connectors.

5. The transformer of claim 4 wherein the U-shaped bus bar connectors comprise a pair of opposing end projections and a bight section, and wherein connections are made between the bus bar array and the end projections.

6. The transformer of claim 5 wherein connections are made between the further bus bar connectors and the bight section of the U-shaped connectors.

7. The transformer of claim 1 including a plurality of bus bar terminals extending through a top portion of the transformer casing for connecting with said first, second and third phases.

8. The transformer of claim 1 including a plurality of bus bar terminals extending through a side portion of the transformer casing for connecting with said first, second and third phases.

* * * * *